United States Patent [19]

Nakanishi et al.

[11] Patent Number: 4,833,065

[45] Date of Patent: May 23, 1989

[54] PROCESS FOR PRODUCING SUPPORT FOR PRESENSITIZED LITHOGRAPHIC PRINTING PLATE USING ALKALINE ELECTROLYTE

[75] Inventors: Haruo Nakanishi; Hirokazu Sakaki, both of Shizuoka, Japan

[73] Assignee: Fuji Photo Film Co., Ltd., Minami-ashigara, Japan

[21] Appl. No.: 914,480

[22] Filed: Oct. 1, 1986

[30] Foreign Application Priority Data

Oct. 4, 1985 [JP] Japan ..... 60-221648

[51] Int. Cl.[4] ..... G03C 1/94; C25D 11/06

[52] U.S. Cl. ..... 430/276; 430/155; 430/158; 430/159; 430/160; 430/161; 430/166; 430/167; 430/278; 204/17; 204/33; 204/58

[58] Field of Search ..... 204/33, 17, 58; 430/276, 278, 155, 158, 161, 166, 167, 159, 160

[56] References Cited

U.S. PATENT DOCUMENTS

| | | | |
|---|---|---|---|
| 3,658,662 | 4/1972 | Casson et al. | 204/58 |
| 3,834,998 | 9/1974 | Watanabe | 204/33 |
| 3,891,516 | 6/1975 | Chu | 204/33 |
| 3,902,976 | 9/1972 | Walls | 204/58 |
| 4,468,295 | 8/1984 | Pliefke | 204/33 |
| 4,476,006 | 10/1984 | Ohba et al. | 204/33 |
| 4,477,317 | 10/1984 | Chu et al. | 204/33 |
| 4,492,616 | 1/1985 | Pliefke et al. | 204/33 |
| 4,554,216 | 11/1985 | Mohr | 204/33 |
| 4,608,131 | 8/1986 | Brenk | 204/33 |
| 4,689,272 | 8/1987 | Simon et al. | 204/33 |

OTHER PUBLICATIONS

S. Wernick, "The Surface Treatment and Finishing of Aluminum and its Alloys", vol. 1, pp. 455-457, 1972.

*Primary Examiner*—Charles L. Bowers, Jr.

*Attorney, Agent, or Firm*—Burns, Doane, Swecker & Mathis

[57] ABSTRACT

In a process for producing a support for a lithographic printing plate, at least one surface of an aluminum sheet is subjected to roughening treatment and subsequently to anodic oxidation treatment at a current density of at least 1 A/dm$^2$ in an electrolytic solution containing 0.1 to 5% by weight of an alkaline electrolyte. Even if scratches are formed on non-image areas of a printing plate prepared from the support according to the invention, such scratches cause less stains on a printed matter.

7 Claims, 1 Drawing Sheet

PROCESS FOR PRODUCING SUPPORT FOR PRESENSITIZED LITHOGRAPHIC PRINTING PLATE USING ALKALINE ELECTROLYTE

FIELD OF THE INVENTION

The present invention relates to a process for producing a support for a lithographic printing plate, particularly to such a process characterized by roughening the surface of an aluminum sheet and subsequently subjecting it to anodic oxidation in an alkaline solution.

BACKGROUND OF THE INVENTION

Hitherto, aluminum sheets have been used as a support for a lithographic printing plate. A roughening process of the surface of the support, i.e., so-called graining process, is conducted to improve adherence between the support and a light-sensitive layer and to provide non-image areas with water retentivity.

Examples of the aforesaid graining process include mechanical roughening processes such as sandblast, ball graining, wire graining, brush graining with a nylon brush and an abrasive/water slurry, and a liquid honing (e.g. jetting of a high pressure abrasive/water slurry to the surface), and chemical roughening processes such as surface roughening treatment with etching agents, for instance alkali, acid or a mixture thereof. Further, an electro-chemical graining process as described in Japanese Patent Application (OPI) No. 146234/79 (the term "OPI" as used herein refers to a "published unexamined patent application") and Japanese Patent Application (OPI) No., 28123/73, such as a process of a combination of mechanical graining and electrochemical graining as described in Japanese Patent Application (OPI) 123204/83 and a process of a combination of mechanical graining and chemical graining with an aqueous saturated solution of an aluminum salt of mineral acid as described in U.S. Pat. No. 4,242,417.

Aluminum plates which have been subjected to the aforesaid roughening treatment may be used as a support for a lithographic printing plate as such or after further chemical treatment. However, in the case where a lithographic printing plate is desired to have the high printing durability, anodic oxidation treatment is further carried out to enhance adhesion of images to the support and to raise mechanical strength of the surface of non-image areas.

In the field of the production of supports for printing plates, the anodic oxidation treatment is performed by applying a direct or alternating current to an aluminum sheet in an aqueous or non-aqueous solution of sulfuric acid, phosphoric acid, chromic acid, oxalic acid, sulfamic acid, boric acid, benzenesulfonic acid or a combination of two or more of these acids.

As mentioned above, the anodic oxidation treatment is carried out using various electrolytic solutions. Above all, sulfuric acid and phosphoric acid are commonly used.

A presensitized plate from which a lithographic printing plate is to be prepared is subjected to a plate-making process comprising imagewise exposure, development and application of desensitizing gum. The resulting printing plate is then mounted to a printing machine to perform printing. Sometimes, scratches are formed on the printing plate during transfer or plate-making or at the time when dust is removed from the printing face during printing. In the case where such scratches are present on non-image areas, ink will deposit on the parts of scratches during printing, which will then cause stains in the form of the scratches on a printed matter.

When the surface of the non-image areas is treated by anodic oxidation as stated above to create an alumina coating on the surface, the surface becomes hard and is not easily scratched. Thus, appearance of scratch-form stains is prevented. This effect may be enhanced by increasing the amount of the anodic oxidation coating. However, the increase of the amount of the anodic oxidation coating requires a lot of electric power, which results in the increase of production costs.

SUMMARY OF THE INVENTION

Accordingly, from the viewpoint of the disadvantages of the prior art as mentioned above, an object of the present invention is to provide anodic oxidation treatment technique where the amount of an anodic oxidation coating is relatively small and, even if scratches are formed on non-image areas, they scarcely result in stains.

It has now been found that the above object is attained by a process characterized in that at least one surface of an aluminum or aluminum alloy sheet is subjected to roughening treatment and subsequently to anodic oxidation treatment at a current density of at least $1A/dm^2$ in an electrolytic solution containing 0.1 to 5% by weight of an alkaline electrolyte.

DETAILED DESCRIPTION OF THE INVENTION

Figure 1A:
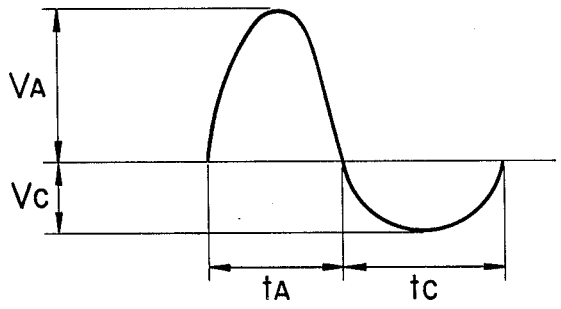
FIG. 1 shows voltage wave patterns of alternating currents used in electrolytic roughening treatment of a support according to the invention. (*a*) shows a sinusoidal wave; (*b*) a rectangular wave; and (*c*) trapezoidal wave.

Aluminum sheets used in the present invention include a pure aluminum sheet and an aluminum alloy sheet. Various aluminum alloy may be used, such as those composed of aluminum as a main component and small amounts of silicon, copper, manganese, magnesium, chromium, zinc, lead, bismuth, or nickel. These alloys may include small amounts of iron and titanium as well as negligible amounts of other impurities.

In practicing the present invention, it is preferred that an aluminum sheet is first subjected to graining treatment. Before this, the aluminum sheet may be subjected to cleaning treatment to remove oil, fat, stain and dust adhered to the surface of the aluminum sheet, if necessary. The cleaning treatment may be performed by, for instance, solvent degreasing with trichlene, etc., or alkali etching degreasing with an aqueous caustic soda solution, etc. In the case of the alkali etching degreasing, smut occurs. Accordingly, desmutting treatment, such as soaking in 10 to 30% nitric acid, is usually conducted to remove the smut.

Roughening treatment may be performed by the aforesaid various manners. For instance, sandblast, ball graining, brush graining with a nylon brush and an abrasive/water slurry, and liquid honing may be named as mechanical graining methods. "Fundamentals of Lithographic Printing" (Kenichi Sugiyama, Dec. 1, 1965, Insatsu Jihosha), pages 35 to 37, describes mechanical roughening treatment. Chemical roughening treatment includes a method where an aqueous saturated solution of an aluminum salt of mineral acid is used for treatment, as described in U.S. Pat. No. 4,201,836. Electrochemical graining includes the methods disclosed in U.S. Pat. No. 4,087,341 and Japanese Patent Applications (OPI) No. 28123/73. Further, the method of a combination of mechanical roughening and chemical roughening described in U.S. Pat. No. 4,242,417, and the method of a combination of mechanical roughening and electrochemical roughening described in U.S. Pat. No. 2,344,510, Japanese Patent Publication No. 16918/82 and U.S. Pat. No. 4,476,006 may also be used. A combination of chemical roughening and electrochemical roughening may be used. Particularly, the chemical roughening, the combination of mechanical roughening and chemical roughening and the combination of chemical roughening and electrochemical roughening permit to highly attain the effect of the invention.

The aluminum sheet thus roughened is preferably subjected to chemical cleaning treatment. The chemical cleaning treatment is to remove an abrasive or aluminum chips which thrust into the surface after the mechanical roughening. When the chemical cleaning treatment is carried out after the chemical or electrochemical roughening, it is to remove so-called smut which is a substance remaining on the surface. Details of such chemical cleaning treatment are described in U.S. Pat. No. 3,834,998.

The aluminum sheet which has been subjected to the roughening treatment and the cleaning treatment is then subjected to the anodic oxidation treatment.

The electrolytic solution used in the anodic oxidation treatment according to the present invention is an aqueous alkaline solution. This contains, for instance, hydroxides such as sodium hydroxide and potassium hydroxide, phosphates such as sodium tertiary phosphate and potassium tertiary phosphate, aluminates such as sodium aluminate, carbonates such as sodium carbonate, silicates such as sodium metasilicate or mixtures thereof. Above all, an aqueous solution of sodium hydroxide, sodium aluminate which is a reaction product of sodium hydroxide and aluminum, or a mixture thereof is preferred on account of their relatively low costs and, particularly, relative easiness of waste liquid disposal.

The concentration of the electrolyte in the electrolytic solution is 0.1 to 5% by weight. If the concentration of the electrolyte is less than 0.1% by weight, an anodic oxidation voltage will become higher and burned which will result uneven treatment. On the other hand, if the concentration of the electrolyte is higher than 5% by weight, dissolution reaction of the aluminum body or a formed oxidation coating will become vigorous, which results in destruction of the rough surface and deterioration of coating formation efficiency. Because the above oxidation is an anodic oxidation in the alkaline electrolytic solution, dissolution reaction of aluminum occurs inevitably and aluminum will be present in the solution in the forms of sodium aluminate and so on. Therefore, a solution which contains aluminum is favorable from the viewpoint of concentration control. Preferred is an electrolytic solution containing aluminate ion in an amount of 0.1 to 5% by weight (calculated as aluminum ion). It will be appreciated that the aqueous aluminum solution referred to in the rest of the specification actually is an aluminate solution. If the aluminum concentration is higher than 5% by weight, insoluble materials will often occur. On the other hand, if the aluminum concentration is lower than 0.1% by weight, an overflowing amount of liquid will become larger for proper concentration control, which unfavorably increases a load on waste liquid disposal.

A temperature of the electrolytic solution is preferably 50° C. or below. If the temperature is higher than 50° C., dissolution reaction of aluminum or the oxidation coating will become vigorous, which is unfavorable.

It is necessary that the anodic oxidation treatment is conducted at a current density of at least 1 $A/dm^2$. If the anodic oxidation treatment is carried out at a current density of less than 1 $A/dm^2$, uneveness in treatment will occur on the whole surface, which results in a nonuniformly treated surface. There is no particular upper limit on the current density, but a current density of 20 $A/dm^2$ or less is usually sufficient. The current may be direct or alternating, but a direct current is preferred because it leads to a shorter treatment time in continuous treatment.

The aluminum sheet thus anodically oxidized may further be treated so as to make it hydrophilic, for instance, by immersion in an aqueous solution of alkali metal silicate such as sodium silicate as described in U.S. Pats. Nos. 2,714,066 and 3,181,461, or by treatment with polyvinylsulfonic acid as described in U.S. Pat. No. 4,153,461 or may be provided with an undercoating of hydrophilic cellulose (e.g., carboxymethyl cellulose) containing a water-soluble metal salt (e.g., zinc acetate) as described in U.S. Pat. No. 3,860,426.

On the support for a lithographic printing plate thus obtained, a known light-sensitive layer may be provided as a light-sensitive layer of a PS Plate (Pre-Sensitized Plate). A lithographic printing plate obtained by platemaking of the thus obtained PS plate has excellent properties.

As a composition of the aforesaid light-sensitive layer, there may be mentioned (a) one comprising a diazo resin and a binder, (b) one comprising an O-naphthoquinone diazide compound, (c) one comprising an azide compound and a binder, (d) a photopolymerizable composition comprising an ethylenically unsaturated monomer, a photopolymerization initiator and a polymeric binder, and (e) one comprising a photocrosslinking polymer having a group of —CH=CH—CO— in a main chain or side chains of the polymer. U.S. Pat. No. 4,238,560 describes details of these substances. Such a light-sensitive layer is provided in an coated amount of about 0.1 to about 7 $g/m^2$, preferably 0.5 to 4 $g/m^2$ after drying on the support prepared according to the invention.

The invention will further be described below in detail, wherein "%" represents percentage by weight unless otherwise noted.

EXAMPLE 1

Figure 1B:
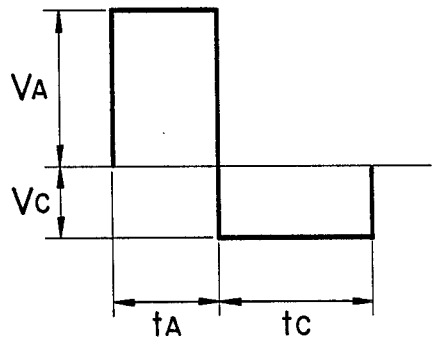
Figure 1C:
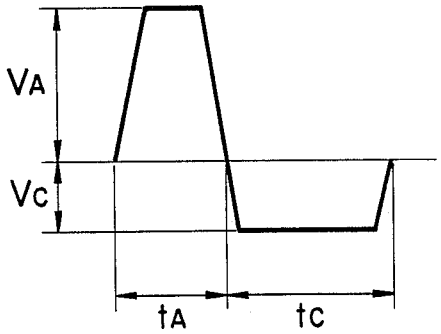

An aluminum sheet of 0.24 mm in thickness was grained by a rotary nylon brush in a suspension of 400 mesh pumice-water so that centerline average roughness was at least 0.3 μm., then washed with water, soaked in an aqueous 10% sodium hydroxide solution at 50° C. for 60 seconds to remove the abrasive, aluminum chips which thrusted into the surface of the aluminum sheet and to thereby make the surface even and neat, subsequently washed with water and, then, with a 20% nitric acid solution for neutralization. After water washing, electrolytic roughening treatment was conducted in an aqueous nitric acid having a concentration of 7 g/l as an electrolytic solution using an alternating current having a wave pattern shown in FIG. 1 (*b*). FIG. 1 shows voltage wave patterns of alternating currents. FIG. 1 (*a*) shows an alternating voltage pattern with a sinusoidal wave; FIG. 1 (*b*), a rectangular wave; and FIG. 1 (*c*), a trapezoidal wave. Any of these patterns may be used in the present invention.

Electrolytic conditions in the electrochemical graining are: frequency=60 Hz, $V_A$=25 volts, $V_c$=13 volts, the quantity of electricity at the anode time ($Q_A$)=176 coulombs/dm$^2$ and cathode time ($Q_C$)=125 coulombs/dm$^2$ ($Q_C/Q_A$=0.71). The aluminum sheet was soaked in an aqueous 10% sodium hydroxide solution at 40° C. for 10 seconds to remove smut formed during the electrochemical graining, washed with a 20% nitric acid for neutralization and washed with water to obtain a substrate, A.

Then, this substrate was subjected to anodic oxidation treatment at a temperature of 25° C. and a current density of 3 A/dm$^2$ in an aqueous solution containing 1% of sodium hydroxide and 0.5% of aluminum so that the amount of an oxidation coating was 1.2 g/m$^2$, washed with water and dried to obtain a support, A'. On support A' thus obtained, a light-sensitive solution having the following composition was coated and dried to provide a light-sensitive layer. The coated amount of the light-sensitive layer was 2.5 g/m$^2$ after drying.

Light-Sensitive Solution

| | |
|---|---|
| Ester compound of naphthoquinone-1,2-diazido-5-sulfonylchloride and a pyrogallol-acetone resin (described in Example 1 of U.S. Pat. No. 3,635,709) | 0.75 g |
| Cresol-novolak resin | 2.00 g |
| Tetrahydrophthalic anhydride | 0.15 g |
| Oil Blue No. 603 (oil-soluble blue dye, produced by Orient Chemical Co.) | 0.04 g |
| O—Naphthoquinonediazido-4-sulfonylchloride | 0.04 g |
| Ethylene chloride | 16 g |
| 2-Methoxyethylacetate | 12 g |

The presensitized plate thus prepared was exposed, through a positive transparency for 60 seconds, to light of a 2 kW metal halide lamp at a distance of 1 m, and developed with a developing solution at 25° C. having the following composition and further gummed up.

Developing solution

| | |
|---|---|
| Sodium metasilicate | 90 g |
| JIS (Japan Industrial Standard) No. 3 sodium silicate | 4 g |
| Water | 1000 g |

On the non-image areas of the lithographic printing plate thus made up, scratches were formed by a sapphire needle having a tip diameter of 0.4 mm at a load of 1 g to 100 g at a constant speed. Then, this plate was used for printing in a conventional manner and evaluated for a load which caused stains of a scratch form on a printed matter. The results are summarized in Table 1.

Comparison 1

Substrate A obtained in Example 1 was subjected to anodic oxidation treatment at a temperature of 25° C. and a current density of 3 A/dm$^2$ in an aqueous 18% sulfuric acid solution so that the amount of an oxidation coating was 1.2 g/m$^2$, washed with water and dried to obtain a support, B'. Subsequently, the procedures from the coating of the light-sensitive layer to the evaluation of printing in Example 1 were repeated. The results are shown in Table 1.

EXAMPLE 2

Substrate A obtained in Example 1 was subjected to anodic oxidation treatment at a temperature of 25° C. and a current density of 3 A/dm$^2$ in an aqueous solution containing 1% of sodium hydroxide and 0.5% of aluminum so that the amount of an oxidation coating was 1.2 g/m$^2$, washed with water, soaked in an aqueous 2% sodium silicate solution at 70° C. for 1 minute, washed with water and dried to obtain a support, C'.

On support C' thus prepared, a light-sensitive solution having the following composition was coated and dried to provide a light-sensitive layer. The coated amount of the light-sensitive layer was 2.5 g/m$^2$ after drying.

Light-Sensitive Solution

| | |
|---|---|
| N—(4-hydroxyphenyl) methacrylamide/2-hydroxyethylmethacrylate/acrylonitrile/methyl methacrylate/methacrylic acid copolymer (molar ratio, 15/10/30/38/7, average molecular weight 60,000) | 5.0 g |
| Hexafluorophosphate of a condensate of 4-diazodiphenylamine and formaldehyde | 0.5 g |
| phosphorous acid | 0.05 g |
| Victoria Pure Blue BOH (Hodogaya Chemical Co.) | 0.1 g |
| 2-Methoxyethanol | 100 g |

The presensitized plate thus prepared was exposed, through a negative transparency for 50 seconds, to light of a 3 kW metal halide lamp at a distance of 1 m, and developed with a developing solution having the following composition and gummed up with an aqueous gum arabic solution to obtain a lithographic printing plate.

Developing Solution

| | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1000 g |

The procedures from the scratching to the evaluation of printing in Example 1 were repeated. The results are shown in Table 1.

Comparison 2

Substrate A obtained in Example 1 was subjected to anodic oxidation treatment in an aqueous sulfuric acid solution in the same manner as in Comparison 1, washed with water and then soaked in an aqueous 2% sodium silicate solution at 70° C. for 1 minute, washed with water and dried to obtain a support, D'. Subsequently, the procedures from the coating of the light-sensitive layer to the evaluation of printing were conducted as in Example 2. The results are shown in Table 1.

TABLE 1

| Support | Example 1 | Comparison 1 | Example 2 | Comparison 2 |
|---|---|---|---|---|
| Support | A' | B' | C' | D' |

TABLE 1-continued

| Support | Example 1 | Comparison 1 | Example 2 | Comparison 2 |
|---|---|---|---|---|
| Roughening treatment | mechanical and electrochemical | mechanical and electrochemical | mechanical and electrochemical | mechanical and electrochemical |
| Anodic oxidation bath | sodium hydroxide | sulfuric acid | sodium hydroxide | sulfuric acid |
| Amount of oxidation coating | 1.2 g/m$^2$ | 1.2 g/m$^2$ | 1.2 g/m$^2$ | 1.2 g/m$^2$ |
| Load causing scratches on printing plate | 2 g | 2 g | 2 g | 2 g |
| Load causing stains of a scratch form on printed matter | 50 g | 2 g | 50 g | 2 g |

As seen from Table 1, in the case where printing is carried out using a lithographic printing plate prepared from a support according to the invention, stains of a scratch form are more hardly caused on a printed matter even when scratches are caused on the plate, as compared with the case of a support treated by anodic oxidation with sulfuric acid.

In the above Examples, the roughening treatment was a combination of mechanical roughening and electrochemical roughening, and the anodic oxidation was conducted in a sodium hydroxide bath. Similar results were obtained using other roughening treatments and anodic oxidation with other alkaline solutions.

What is claimed is:

1. A process for producing a presensitized lithographic printing plate including a aluminum sheet support and a light sensitive layer comprising subjecting at least one surface of an said support to a two step roughening treatment including both mechanical and electrolytic roughening and subsequently to anodic oxidation treatment at a current density of at least 1 A/dm$^2$ in an electrolytic solution containing 0.1 to 5% by weight of an alkaline electrolyte, the electrolyte being (i) sodium or potassium hydroxide and (ii) aluminate ion, the weight percent of aluminate ion being based on aluminum and applying a light sensitive layer to the anodized support.

2. The process of claim 1, wherein the anodized surface is treated with an aqueous alkali metal silicate solution so as to make it hydrophilic.

3. The process of claim 1, wherein the surface of the aluminum sheet is subjected to chemical cleaning treatment after the roughening and before the anodic oxidation.

4. The process of claim 1, wherein the alkaline electrolyte is sodium or potassium aluminate.

5. The process of claim 1, wherein the anodic oxidation is conducted at a temperature of 50° C. or lower.

6. The process of claim 1, wherein the anodized surface is treated with polyvinyl sulfonic acid so as to make it hydrophilic.

7. The process of claim 1, wherein the anodized surface is provided with an undercoating of hydrophilic cellulose containing a water-soluble metal salt.

* * * * *